US005088973A

United States Patent [19]

Bruce et al.

[11] Patent Number: 5,088,973

[45] Date of Patent: Feb. 18, 1992

[54] METHOD AND APPARATUS FOR FOLDING PRINTED/COATED SHEET MATERIAL

[75] Inventors: Wayne H. Bruce, 110 Whispering Water Way, Edgewater, Md. 21037; Howard A. Lewis, New Carrollton; James R. Smith, Rockville, both of Md.

[73] Assignee: Wayne H. Bruce, Edgewater, Md.

[21] Appl. No.: 424,751

[22] Filed: Oct. 23, 1989

[51] Int. Cl.[5] ..... B31F 1/10; B31B 1/25

[52] U.S. Cl. ..... 493/396; 493/403; 493/470

[58] Field of Search ..... 493/59, 60, 61, 160, 493/161, 396, 397, 398, 399, 402, 403, 470

[56] References Cited

U.S. PATENT DOCUMENTS

| | | | |
|---|---|---|---|
| 3,240,611 | 3/1966 | Williams | 493/60 |
| 3,379,814 | 4/1968 | Bracey | 493/396 |
| 3,981,213 | 9/1976 | Lopman | 493/60 |
| 4,067,761 | 1/1978 | Shirley | 156/583.1 |
| 4,179,252 | 12/1979 | Seufert | 425/384 |
| 4,406,648 | 9/1983 | Cavagna et al. | 493/161 |
| 4,586,917 | 5/1986 | Robinson | 493/399 |
| 4,808,150 | 2/1989 | Herrington et al. | 493/470 |
| 4,931,031 | 6/1990 | Lisiecki | 493/60 |
| 4,936,818 | 6/1990 | Holohan | 493/403 |

*Primary Examiner*—William E. Terrell
*Attorney, Agent, or Firm*—William H. Holt

[57] ABSTRACT

A method and apparatus for use with folding machines of the type having a score roll for scoring sheet material which has been coated and/or printed with ink and the like. The method includes, and the apparatus provides for, heating the score roll to a sufficiently high temperature (generally 150°–400° F.) for softening or otherwise tempering the coating material and/or ink for precluding, or minimizing, unsightly damage resulting from cracking of the coating during scoring and creasing, bending or folding of the sheet material along the score line.

9 Claims, 3 Drawing Sheets

Fig.1
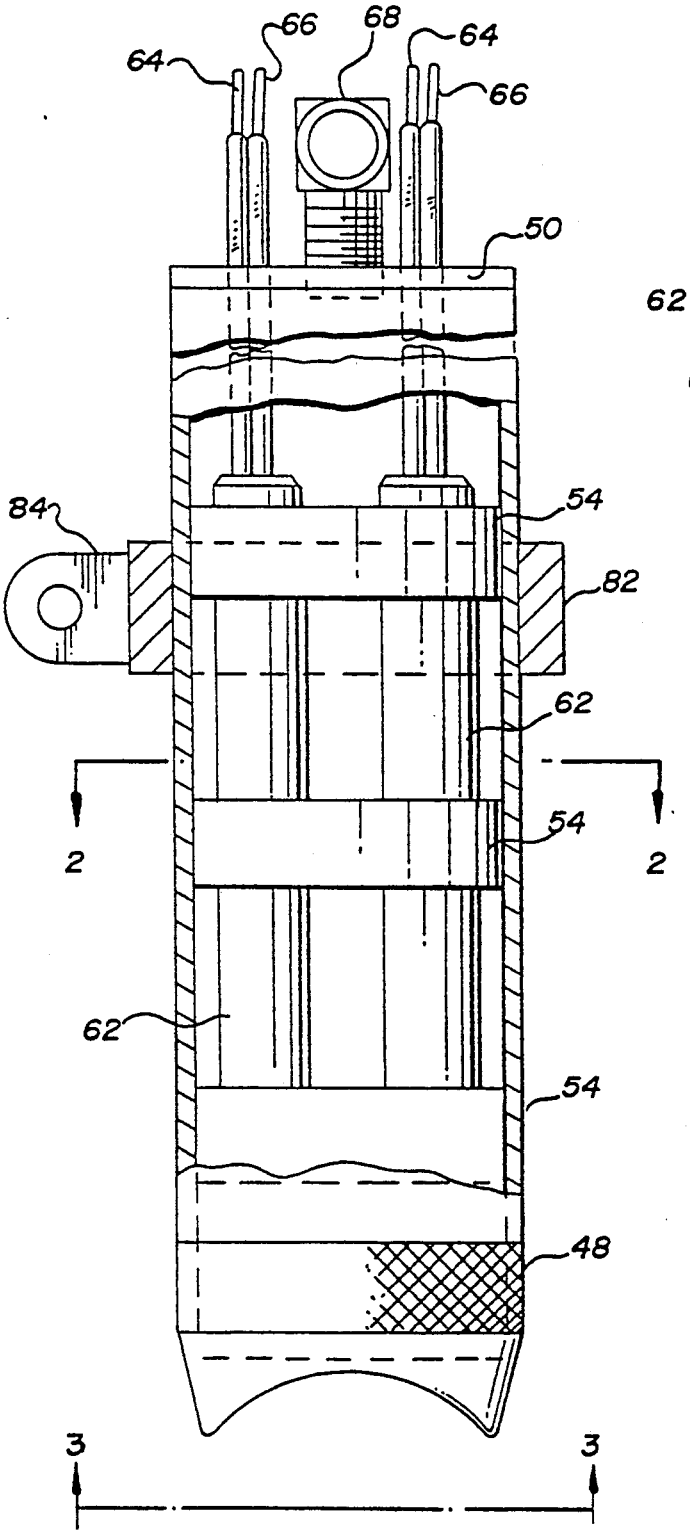
Fig.2
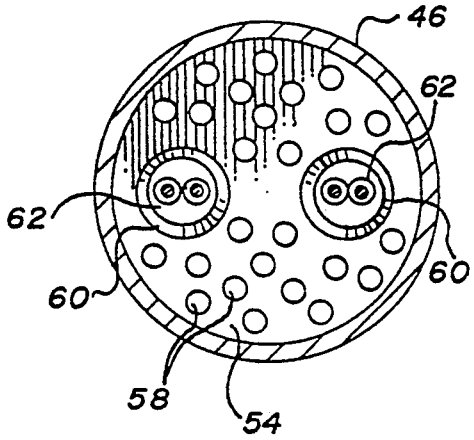
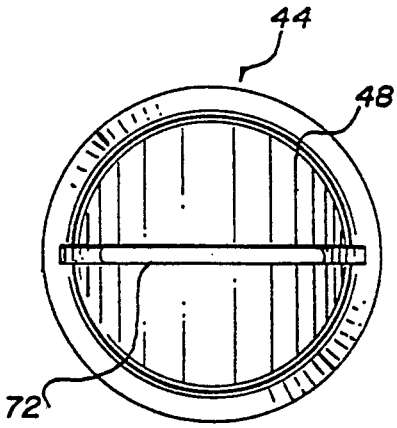
Fig.3

Fig. 4
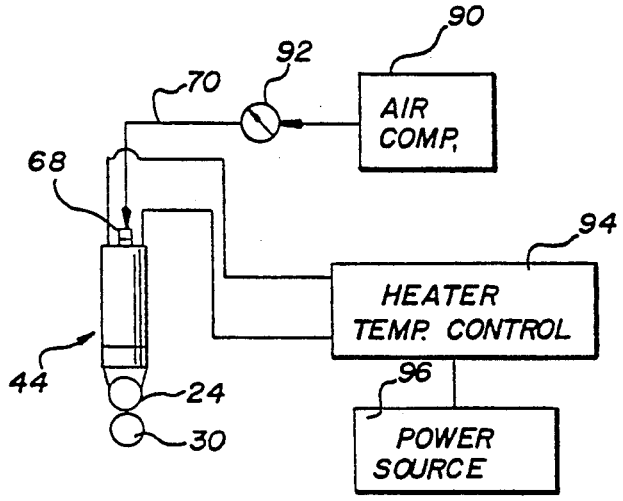
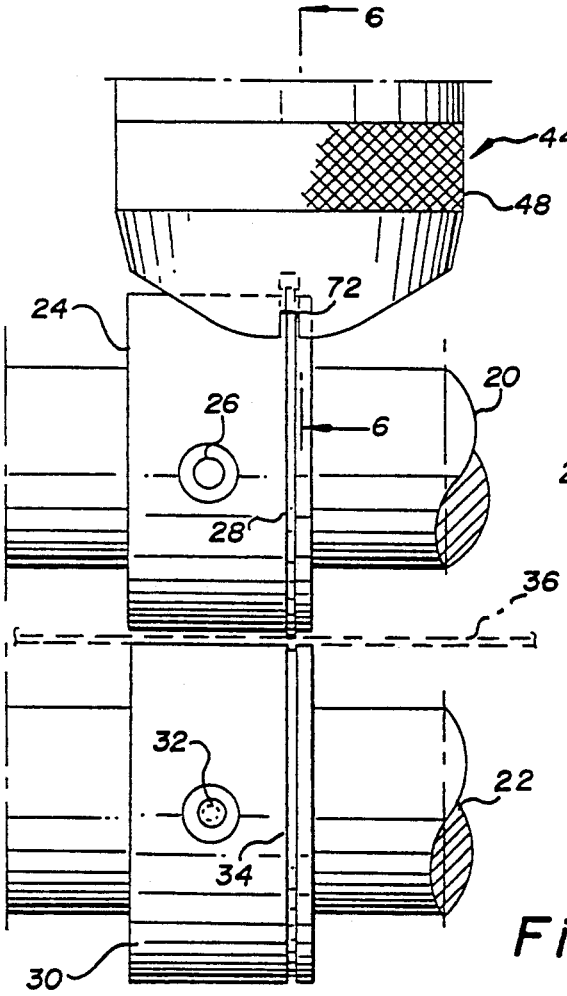
Fig. 5
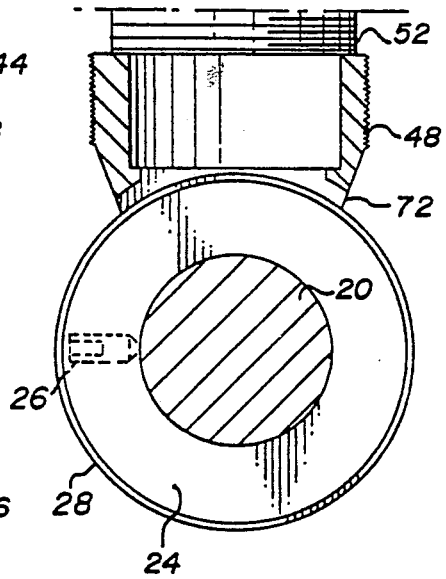
Fig. 6

Fig. 7
Fig.8
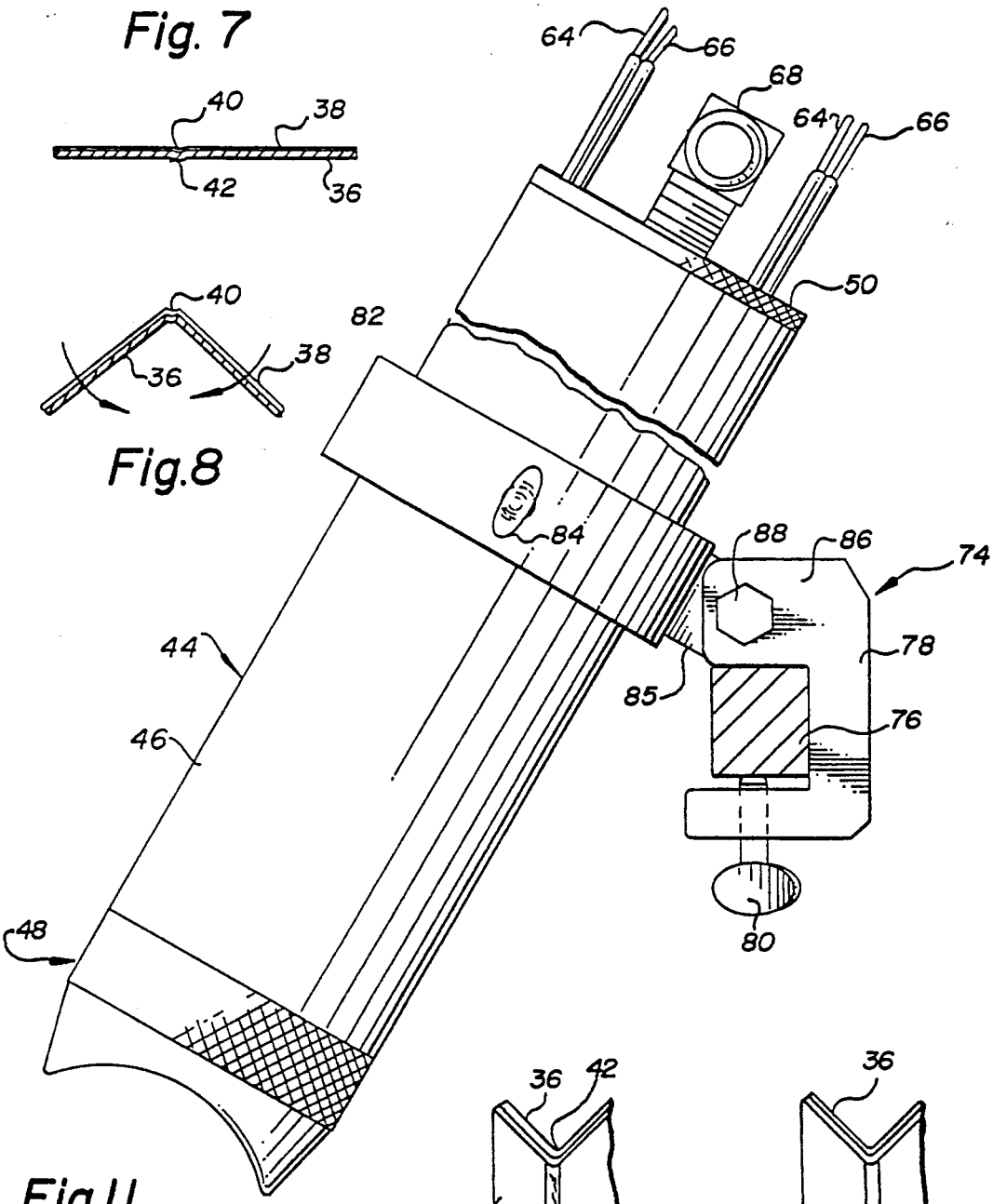
Fig.11
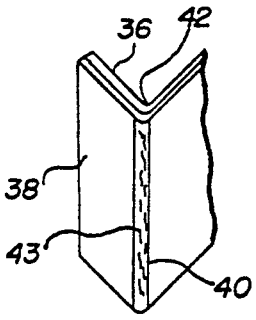
Fig. 9
(PRIOR ART)
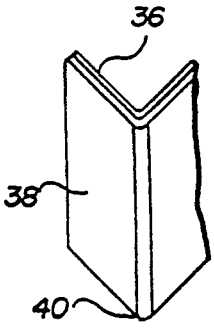
Fig.10

METHOD AND APPARATUS FOR FOLDING PRINTED/COATED SHEET MATERIAL

This invention relates in general to new and useful improvements in the method of and apparatus for scoring sheet material which has been coated and/or printed with ink and the like, and more particularly to an improved score roll or rule arrangement.

It is conventional to score a web or sheet prior to folding along the intended line of fold. However, when the web or sheet has been coated and/or printed with ink and the like, unsightly damage due to cracking of the coating occurs. This invention relates to the elimination of such cracking.

When a printed or coated sheet or web is to be transversely folded, it first passes between a collar provided with an annular score roll or rule with that collar being backed up by a grooved collar for receiving the annular rule. Thereafter by means of belts or rolls, the scored web or sheet is folded together on the side opposite the score. Because of the deformation of the coating and/or ink during the scoring, when the sheet or web is folded, the coating and/or ink cracks and when the coating or ink is colored, becomes unsightly damaged. In accordance with this invention, it has been found that if the score roll or rule is heated to a sufficiently high temperature (on the order of 150°–400° F.) this unsightly cracking is eliminated.

Accordingly, it is a primary feature of this invention to provide a heater for efficiently and continuously heating the score roll or rule to the required temperature. The heater is adjustably mounted on the folding machine and is provided with a heat supplying end which will closely clear the collar carrying the score roll or rule while at the same time receiving a portion of the score roll or rule to effectively heat the same as it rotates.

In accordance with this invention, it has been found that hot air efficiently functions to heat the score roll or rule and compressed air, which is readily available at the folder, is directed through a housing in which there is positioned at least one electric cartridge heater and the cartridge heater is mounted within axially spaced transverse partitions within the housing, the partitions being in contact with the cartridge heater and being formed of a good heat conductive material. Further, the partitions are perforated for heat transfer to air flowing therethrough and through the housing.

With the above and other objects in view that will hereinafter appear, the nature of the invention will be more clearly understood by reference to the following detailed description, the appended claims, and the several views illustrated in the accompanying drawings.

FIG. 1 is an elevational view with parts broken away and shown in section of a heater formed in accordance with this invention and shows the general details thereof.

FIG. 2 is a transverse horizontal sectional view taken generally along the line 2—2 of FIG. 1 and shows the details of a perforated partition carrying two cartridge heaters.

FIG. 3 is a bottom elevational view showing the end of the heater which is associated with the score roll or rule.

FIG. 4 is a schematic view showing the use of the heater in conjunction with a score roll or rule.

FIG. 5 is a fragmentary elevational view showing a conventional score roll or rule arrangement with the score roll or rule being heated by the heater, only the lower end of the heater being shown.

FIG. 6 is a fragmentary vertical sectional view showing the relationship of the score roll or rule with respect to the lower end of the heater.

FIG. 7 is a fragmentary transverse view on a large scale showing the formation of a score in a web or sheet in accordance with the invention.

FIG. 8 is a fragmentary sectional view showing the manner in which the sheet or web is folded along the score.

FIG. 9 is a view rotated 180° from that of FIG. 8 and shows the prior art cracking of the ink and/or coating.

FIG. 10 is a fragmentary perspective view similar to FIG. 9 and shows a folded sheet or web that is free of cracking in accordance with this invention.

FIG. 11 is an elevational view showing the mounting of the heater on a tie rod of the folding machine, a portion of the heater being broken away.

Referring now to the drawings in detail reference is first made to FIG. 5 wherein there is illustrated that portion of an existing folding machine which scores a sheet or web along the line of intended folding. This portion of the folding machine includes a pair of shafts 20, 22 which are driven. The shaft 20 is provided with a collar 24 which is locked in place thereon by means of a conventional set screw 26. The collar 24 rotates with the shaft 20 and carries an annular score or rule 28 which projects radially outwardly of the surface of the collar 24 as is best shown in FIG. 6.

Associated with the collar 24 and adjustably mounted on the shaft 22 for rotation therewith is a second collar 30. The collar 30 is positioned on the shaft 22 by means of a set screw 32. The collar 24 is provided with an annular groove or recess 34 which is aligned with the rule 28 and into which a sheet or web to be scored is deformed.

A typical web or sheet 36 which is being scored is illustrated in position between the collars 24, 30.

Referring now to FIG. 7, it will be seen that the sheet or web 36 is more specifically illustrated as having on the upper surface thereof a further layer 38 in the form of a coating and/or ink. The sheet or web 36 has been scored with the result that the upper surface thereof is scored or recessed as at 40 whereas the under surface thereof is provided with a minute rib 42.

Referring now to FIG. 8, it will be seen that the sheet or web 36 is folded in alignment with the score 40 with the score 40 being disposed outermost.

Reference is now made to the prior art showing of FIG. 9 wherein the folded sheet or web 36 is viewed from the scored edge thereof. It will be seen that in alignment with the score 40 the layer 38 in the form of a coating and/or ink has a plurality of cracks 43 along the score line 40. These cracks are unsightly and are especially undesirable when a high quality printing job is damaged during routine folding.

Reference is next made to FIG. 10 which is a fragmentary perspective view similar to the prior art showing of FIG. 9 but wherein the layer 38 is free of the cracks 42 along the score 40. This is the desired appearance of a folded sheet or layer and is obtained in accordance with this invention as will be described in more detail hereinafter.

In accordance with this invention, the scoring apparatus of FIG. 5 is modified by providing a heater, generally identified by the numeral 44 for heating the score roll or rule 28. The heater is best illustrated in FIGS. 1-3 and will be described in detail here.

The heater 44 is in the form of a tubular housing 46 which is closed at its lower end by an end 48 and its upper end by a cap 50. As is best shown in FIG. 6, the end 48 has a reduced diameter and externally threaded upper portion 52 which is telescoped within and threaded to the lower part of the housing 46. Although not shown with respect to the cap 50, the cap 50 is of a like construction and is threadedly secured to the housing 46.

The tubular housing 46 may be formed of metal, as illustrated, or could be formed of a suitable insulating material so as prevent the loss of heat.

Within the housing 46 are axially spaced baffle forming partition members or supports 54 which are preferably in forced engagement with the interior of the housing 46. Each of the partition members 54 is of a perforated construction and has a large number of small diameter bores 58 therethrough. Further, each of the partition members 54 is formed of a good heat conductive material, such as aluminum or copper, and is of a thickness so as to provide for good heat transfer.

In addition to the small diameter bores 58, each partition member 54 is provided with one or more larger diameter bores 60. The bores 60 are of a size to have snugly received therein a cartridge heater 62 and in the preferred embodiment of the invention, two cartridge heaters are utilized. It is to be understood, however, that the number of cartridge heaters may vary.

A this time it is pointed out that cartridge heaters come in different sizes and different capacities and while the invention is in no way restricted to any specific cartridge heater or number of cartridge heaters, in the preferred embodiment of the invention, there are utilized two cartridge heaters manufactured by Vulcan Electric Company and are identified as follows:

VULCAN P88
550W 120V
TB506 4TB1
Thunderbolt

It is to be understood that the body temperature of the above identified cartridge heaters are on the order of 1200° F.

Each of the cartridge heaters 62 is provided with a pair of leads 64, 66 with these leads extending through the cap 50.

At this time it is to be noted that the cap 50 is provided with a suitable air line fitting 68 to which a suitable compressed air line 70 (FIG. 4) will be attached.

Referring once again to FIG. 5, it will be seen that the housing end 48 in one side elevation is of a generally rounded blunt configuration. On the other hand, as is shown in FIG. 1, the housing end 48 is of an arcuate recess configuration. Further, as is best shown in FIG. 6, it will be seen that the configuration of the housing end 48 is such that it will clear the collar 24 through a considerable angle and is provided with a slot 72 to receive the score roll or rule 28 as is clearly shown in FIGS. 5 and 6. Because of the relatively great arcuate extent of the slot 72, a large portion of the score roll or rule 28 is always within the slot 72 to be heated.

In operation, compressed air at a low pressure is directed into the top of the housing 46 through the fitting 68 and the cap 50. This compressed air flows axially through the housing 46 and most particularly through the bores 58 in the partition members 56 to be highly heated. Depending upon the rate of flow of the air through the heater 44 and the temperature of the cartridges as well as the heating capacity of the cartridges, air exiting through the slot 72 in the housing end 48 will be heated to a temperature ranging generally from 300° to 900° F. This will cause the rule 28 to be selectively heated to a temperature between 150°-400° F. although a higher temperature may be attained, particularly if cartridge heaters of a greater capacity are utilized.

It is to be understood that the housing lower end 48 must be positioned with respect to the collar 24 and the rule 28 as is generally shown in FIGS. 5 and 6. In order to so position the heater 44, there is provided an adjustable support, generally identified by the numeral 74.

It is to be understood that the normal folder machine is provided with a transverse tie bar which is illustrated in FIG. 11 and identified by the numeral 76. The support 74 includes a first clamp 78 which is slidable along the tie bar 76 and which is securable in an adjusted fixed position on the tie bar 76 by means of a clamp screw 80.

The support 74 includes a second clamp member 82 in the form of a ring in which the housing 46 is slidably mounted, as is best shown in FIG. 1. The second clamp 82 carries a second clamp screw 84 which clamps the housing 46 in an adjusted position.

The second clamp 82 is provided with a projecting arm 85 which is positioned in a bifurcated part 86 of the first clamp member 78 and which is pivotal relative to the bifurcated part 86 by means of a combination pivot and clamp screw 88.

It will be readily apparent that the heater 44 may be properly positioned with respect to the rule 28 by sliding the support 74 along the tie bar 76 in order to provide the necessary transverse alignment. The heater 44 may then be tilted relative to the clamp member 78 and may be slid through the clamp member 82 until it is accurately positioned with respect to the score roll or rule 28 as is clearly shown in FIGS. 5 and 6.

Reference is once again made to FIG. 4 wherein it is to be noted that the air line 70 is coupled to an air compressor 90 by way of a pressure control valve 92. It is to be understood that there is associated with the customary folder mechanism a source of compressed air and it is merely necessary to control the pressure of such compressed air direct into the heater 44.

While the cartridge heaters 62 have been illustrated with only two leads 64, 66 it is to be understood that the heater 44 will be provided with a suitable temperature pickup which will be connected to a conventional heater temperature control 94 so as to maintain the cartridge heaters 62 at a preselected temperature.

The cartridge heaters 62 will be energized by way of the temperature control 94 from a conventional power source 96. Accordingly, once the temperature control is adjusted, no further adjustment will be required.

It is to be understood that in accordance with this invention, as the paper is being scored, the coating and/or ink layer thereof which normally cracks is heated to a softening temperature so that when the paper is deformed in the scoring operation, the ink and/or coating thereon will be softened enough to bend as required during the scoring operation. Accordingly, it is to be understood that depending upon the particular coating and/or ink on the paper that is to be folded, the temperature to which the coating and/or ink is heated will vary. At the present, the preferred temperature for the score roll or rule 28 is in the range of 150°-300° F.

although it is foreseeable with certain inks and coatings, that this range will have to be increased.

It is also to be understood that the partition members 54 serve to control the rate of the flow of air through the housing 46 and the number and size of the bores 58 therethrough may be varied so as to control the rate of heat transfer within the housing 46.

Only a preferred embodiment of the heater and its adapation to a folder machine have been specifically illustrated and described herein, it is to be understood that variations may be made in the heater and the application thereof to a folder machine without departing from the spirit and scope of the invention as defined by the appended claims.

We claim:

1. A web folding apparatus for coated webs in the form of sheet material having a coating thereon, scoring means for embossing said coated web along an intended line of fold, said scoring means being in the form of a rotary rule, the improvement comprising heating means for heating said rotary rule for tempering said coating on said sheet material for substantially preventing cracking of said coating, wherein said rule comprises an annular rule carried by a rotating collar, said heating means including a housing having a heat applying end, and said heat applying end being shaped to clear said collar and to provide a slot for receiving said annular rule.

2. A web folding apparatus according to claim 1 wherein said heating means comprises means for heating said rule to a temperature of 150° to 400° F.

3. A web folding apparatus according to claim 1 wherein said heating means includes means for directing heated air onto said rule.

4. A web folding apparatus according to claim 1 wherein said housing has therein a heater and there are means for directing compressed air through said housing for heating by said heater and out through said slot.

5. A web folding apparatus according to claim 4 wherein said heater includes at least one electric cartridge heater.

6. A web folding apparatus according to claim 4 wherein said housing has therein at least one perforated heat conducting partition telescoped over said heater.

7. A web folding apparatus according to claim 1 wherein said housing is in the form of an elongated tube closed at one end by said heat applying end, a plurality of axially spaced partition members, said partition members being formed of a good heat conductor and being perforated for the passage of air therethrough to heat such air, said partitions having axially aligned openings receiving said heater, and there are means for introducing compressed air into said housing and through said partitions and out of said slot for providing heated air to heat said rule.

8. A web folding apparatus according to claim 7 wherein said heater includes at least one electric cartridge heater seated in said axially aligned openings and in heat conducting contact with said partitions.

9. A web folding apparatus according to claim 1 wherein said web folding apparatus includes a transverse tie member, a support for said housing transversely slidably mounted on said tie member, said support including a first clamp slidable on said tie member and a second clamp slidably receiving said housing, and a pivotal connection between said first and second clamps.

* * * * *